US007283759B2

(12) United States Patent
Takahashi et al.

(10) Patent No.: US 7,283,759 B2
(45) Date of Patent: Oct. 16, 2007

(54) IMAGE FORMING APPARATUS WITH HEATING MEMBER CONTROL IN ACCORDANCE WITH TYPE OF RECORDING MATERIAL

(75) Inventors: Keita Takahashi, Abiko (JP); Akihito Mori, Toride (JP); Nobuo Sekiguchi, Moriya (JP); Takashi Nagaya, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 16 days.

(21) Appl. No.: 11/085,548

(22) Filed: Mar. 22, 2005

(65) Prior Publication Data

US 2005/0220466 A1 Oct. 6, 2005

(30) Foreign Application Priority Data

Mar. 31, 2004 (JP) ..... 2004-105247

(51) Int. Cl.
*G03G 15/00* (2006.01)
*G03G 15/20* (2006.01)

(52) U.S. Cl. ..... 399/45; 399/67; 399/329

(58) Field of Classification Search ..... 399/45, 399/67, 68, 69, 21, 33, 320, 328, 329, 124; 219/216; 347/156

See application file for complete search history.

(56) References Cited

U.S. PATENT DOCUMENTS

| | | | | |
|---|---|---|---|---|
| 5,359,401 | A * | 10/1994 | Uehara et al. | 399/67 |
| 5,666,595 | A | 9/1997 | Sameshima et al. | 399/110 |
| 6,253,046 | B1 * | 6/2001 | Horrall et al. | 399/124 |
| 6,311,039 | B1 | 10/2001 | Funamizu et al. | 399/394 |
| 6,393,232 | B1 | 5/2002 | Osari et al. | 399/82 |
| 6,397,035 | B2 | 5/2002 | Kataoka et al. | 399/388 |
| 2001/0048822 | A1 * | 12/2001 | Hanyu et al. | 399/67 |
| 2002/0003216 | A1 | 1/2002 | Kida et al. | 250/548 |
| 2004/0036849 | A1 | 2/2004 | Kida et al. | 355/55 |
| 2004/0247333 | A1 | 12/2004 | Takahashi | 399/68 |
| 2004/0258427 | A1 | 12/2004 | Takahashi | 399/69 |
| 2005/0025511 | A1 * | 2/2005 | Watabe | 399/67 |
| 2005/0025543 | A1 | 2/2005 | Watanabe et al. | 399/391 |
| 2005/0082737 | A1 | 4/2005 | Sasaki et al. | 271/9.12 |

FOREIGN PATENT DOCUMENTS

| | | |
|---|---|---|
| JP | 61-132972 | 6/1986 |
| JP | 3-288171 | 12/1991 |
| JP | 11-194647 | 7/1999 |
| JP | 11-231701 | 8/1999 |
| JP | 2000-235319 | 8/2000 |
| JP | 2004-205673 | 7/2004 |

* cited by examiner

*Primary Examiner*—Sophia S. Chen
(74) *Attorney, Agent, or Firm*—Fitzpatrick, Cella, Harper & Scinto

(57) ABSTRACT

An image forming apparatus of the present invention has an image forming device for forming an image on a recording material; a heating member heating the image formed on the recording material in a nip portion; an endless belt conveying the recording material toward the nip portion formed between itself and the heating member; and a contacting and separating device for bringing the heating member and the belt into contact with each other and for separating the heating member and the belt from each other, wherein when images are continuously formed on a plurality of recording materials, a separating operation can be executed by the contacting and separating device during a time period after the immediately preceding recording material passes through the nip portion and before the subsequent recording material arrives at the nip portion.

7 Claims, 12 Drawing Sheets

IMAGE FORMING APPARATUS WITH HEATING MEMBER CONTROL IN ACCORDANCE WITH TYPE OF RECORDING MATERIAL

BACKGROUND OF THE INVENTION

1. Field of the Invention

The present invention relates to an image forming apparatus forming an image on a recording material, for example an image forming apparatus such as a copier, printer or fax machine.

2. Related Background Art

Conventionally, in an electrophotographic image forming apparatus, a toner image as a developer image is formed on a recording material such as a sheet by an image formation process called Carlson process, and then the toner image is fixed as a permanent image. For fixing systems for this purpose, various systems have been proposed, but hot-pressing systems heating and pressing a toner image to be fixed are common in terms of fixing characteristics, and in particular, roller type fixing apparatuses (roller fixing) making a toner image directly contact a pair of rotating members including a heating source to fix the toner image are often used.

That is, it has as a basic structure a roller pair of a fixing roller (heat roller) thermally adjusted to have a predetermined fixing temperature and a pressure roller abutted against the fixing roller, wherein the roller pair is rotated, a recording material having an unfixed toner image formed thereon is introduced into a fixing nip portion being an abutment portion of the roller pair, and nipped and conveyed to hot pressing-fix the unfixed toner image on the recording material by means of the heat of the fixing roller and the pressure of the fixing nip portion.

The amount of heat given to the recording material bearing the unfixed toner image depends on temperatures of the fixing roller and the pressure roller, and a time period over which the recording material passes through the fixing nip portion, i.e. a fixing nip width and a travel speed of the recording material. The fixing nip width refers to a length of the fixing nip portion along which the recording material travels.

For a fixing apparatus to be mounted on an electrophotographic apparatus having a higher process speed, a fixing apparatus having a larger fixing nip width is required in relation to the amount of heat described above. For increasing the fixing nip width in the roller fixing described above, the diameter of the roller should be increased, and if the diameter of the roller is increased, there arises a problem such that the heat capacity of the roller increases to lengthen the heat-up time (warm-up time) of the roller.

Thus, as a fixing apparatus configuration capable of securing a large fixing nip width without increasing the diameter of the roller, a belt type fixing apparatus is proposed in Japanese Patent Application Laid-Open No. S61-132972.

In such a belt type fixing apparatus, a heat-resistant and flexible endless belt stretched between a plurality of belt stretching members is abutted against a fixing roller being a rotating member for heating to form a fixing nip portion, and the fixing nip portion is made to nip and convey a recording material bearing an unfixed toner image, whereby the unfixed toner image is hot press-fixed on the recording material by means of the heat of the fixing roller and the pressure of the fixing nip portion. This belt type fixing apparatus allows the fixing nip width to be easily set to a larger width by adjusting a width of the endless belt facing the fixing roller. The fixing nip width can be secured independently of the diameter of the fixing roller, and therefore the diameter and the heat capacity of the fixing roller can be reduced, thus making it possible to shorten the start-up time.

Recording materials for use in the image forming apparatus include resin coated sheets (hereinafter referred to as coated sheets) having a high glossiness on the front surface of both front and rear surfaces with an acryl resin, polyolefin resin or the like coated on the surface of the front surface or both front and rear surfaces of the recording material.

However, if the fixing apparatus is made to pass with a toner placed on the coated sheet, an image defect called a blister in which the recording material is partially deformed like a blister may occur. This is caused due to the fact that water in the interior of the coated sheet is evaporated by heating by the fixing apparatus to increase the volume, but due to a coat layer on the surface of the coated sheet, vaporized water vapor is not uniformly dissipated to outside the coated sheet, but collectively discharged to outside the coated sheet from a portion in which the coat layer is thinned or absent, and therefore the coat layer is ruptured.

In such a fixing apparatus, the fixing nip width is large from a configuration viewpoint, a time period over which the fixing roller and the belt contact each other is therefore lengthened, and thus the temperature of the belt is easily elevated. Because the heat capacity of the belt is small compared to a conventional pressure roller, the temperature of the belt is elevated in a short time period. That is, there arises a problem such that the above image defect tends to occur.

For alleviating the problem, it is proposed in Japanese Patent Application Laid-Open No. H11-194647 that the belt and the fixing roller are separated during standby as a method for reducing the amount of heat given from the rear surface of the recording material.

However, the image forming apparatus described in Japanese Patent Application Laid-Open No. H11-194647 has the following problem.

In a continuous image formation job for continuously forming toner images on a plurality of recording materials, the fixing roller and the belt contact each other even during a time period over which no recording material exists in the fixing nip (so called sheet interval), and therefore heat of the fixing roller is transferred to the belt, whereby the temperature of the belt is elevated to cause an image defect as described above. In particular, if the configuration in which the fixing speed is decreased compared to the normal speed or the above sheet interval is lengthened in consideration of fixing characteristics is employed in the continuous image formation job for continuously forming toner images on a plurality of recording materials, the problem described above is notable.

SUMMARY OF THE INVENTION

An object of the present invention is to provide a fixing apparatus which can prevent occurrence of an image defect resulting from elevation of the temperature of a belt when images are continuously formed on a plurality of recording materials.

Another object of the present invention is to provide an image forming apparatus comprising:

image forming device for forming an image on a recording material;

a heating member heating the image formed on the recording material in a nip portion;

an endless belt conveying the recording material toward the nip portion formed between itself and the heating member; and contacting and separating device for bringing said heating member and said belt into the contact with each other and for separating said heating member and said belt from each other, wherein when images are continuously formed on a plurality of recording materials, a separating operation can be executed by the contacting and separating device during a time period after the immediately preceding recording material passes through the nip portion and before the subsequent recording material arrives at the nip portion.

Further object of the present invention is to provide an image forming apparatus comprising:

image forming device for forming an image on a recording material;

heating device for heating the image formed on the recording material, the heating device comprising a heating member heating the image on the recording material in a nip portion, and an endless belt conveying the recording material toward the nip portion formed between itself and the heating device; and contacting and separating device for bringing said heating member and said belt into the contact with each other and for separating said heating member and said belt from each other, wherein if some abnormal event occurs during an image formation job, a separating operation is executed by the contacting and separating device upon interruption of the image formation job.

Further objects of the present invention will be apparent from the following detailed description with reference to the attached drawings.

DESCRIPTION OF THE PREFERRED EMBODIMENTS

Embodiment 1

<Overall Configuration of Image Forming Apparatus>

Figure 1:
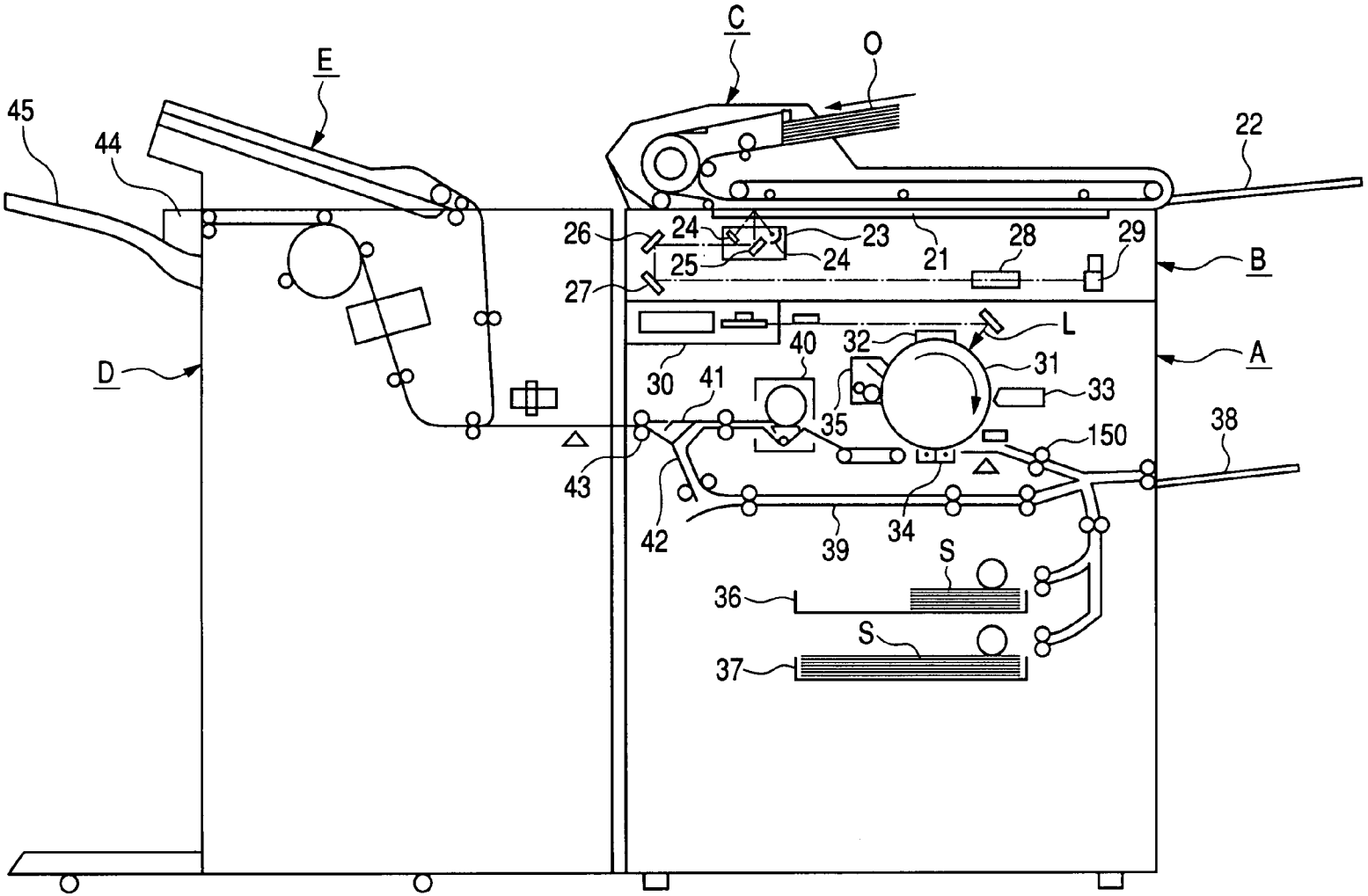
FIG. 1 is a schematic illustration of an embodiment of an image forming apparatus.

FIG. 1 is a model diagram of the general configuration of an image forming apparatus in this embodiment. The image forming apparatus comprises a laser beam scan exposure type printer portion A using a transfer electrophotographic process, an image reader portion B, an original feeding apparatus C and a finisher D. In this embodiment, devices for forming images (unfixed images) on a recording material are collectively referred to as image forming means, and various devices constituting the image forming means will be described in detail below.

The original feeding apparatus C feeds a set original O sequentially on a sheet-by-sheet basis starting with a first page through a curved pass onto a platen glass 21 of the image reader portion B with the image bearing surface faced downward, conveys the original O from the left to the right on the platen glass 21, and discharges it to a sheet discharging tray 22.

At this time, a reader scanner unit 23 of the image reader portion B is held at a predetermined fixed position below the platen glass 21, and photoelectrically reads sequentially in a flowing manner images on the downward faced surface of the original passing on the platen glass 21.

That is, the reader scanner unit 23 illuminates the downward faced surface of the original passing on the platen glass 21 with light from a lamp 24 through the platen glass 21, guides the illuminating light reflected from the surface of the original through mirrors 25, 26 and 27 and a lens 28 to an image sensor 29 to form an image, and photoelectrically reads the image of the original.

Photoelectrical reading of the image of the original by the image sensor 29 can also be carried out by an optical system movement system in which the original is conveyed onto the platen glass 21 by the original feeding apparatus C and temporarily stopped, and the reader scanner unit 23 and the mirrors 26 and 27 are moved from the left to the right along the undersurface of the platen glass 21.

An electric signal of the image of the original read by the image sensor 29 is subjected to image processing and sent to an exposure controlling portion (laser scanner) 30. The exposure controlling portion 30 outputs laser light L modulated in response to the electric signal of the image of the original subjected to image processing.

Reference numeral 31 denotes a drum type electrophotographic photosensitive member (hereinafter referred to as photosensitive drum) as an image bearing member, which is rotationally driven at a predetermined speed in the clockwise direction shown by the arrow.

The photosensitive drum 31 is subjected to a uniform charging treatment at a predetermined polarity/potential in a rotational state by a charging device 32, and then has the charging treatment surface subjected to scan exposure by laser light L output from the exposure controlling portion 30.

Thus, an electrostatic latent image corresponding to a scan exposure pattern is formed on the surface of the photosensitive drum 31. The electrostatic latent image is developed as a toner image by a developing device 33.

In a transferring portion 34, the toner image formed on the photosensitive drum 31 is transferred to a sheet S as a recording material fed to the transferring portion 34 from any one of a first or second sheet feeding cassette 36 or 37, a manual sheet feeding portion 38 and a double side conveying pass 39.

The sheet S, to which the toner image is transferred in the transferring portion 34, is separated from the surface of the photosensitive drum 31 and introduced into a fixing apparatus 40, and has the toner image fixed thereon.

The surface of the photosensitive drum 31 after separation of the sheet gas residual deposited materials such as a post-transferring residual toner and a sheet powder removed therefrom by a cleaning device 35 and is thus cleaned, and is repeatedly used for image formation.

The sheet which has passed through the fixing apparatus 40 as an image heating apparatus is guided to a pass 42 on a temporary basis by a flapper 41, and after the rear end of the sheet is leaves the flapper 41, the sheet switched back and guided to a discharging roller 43 by the flapper 41 in the case of the single side image formation mode. Thus, the sheet is discharged from the printer portion A to the finisher D side by the discharging roller 43 with the image bearing surface faced downward (face down).

In the case of a mode in which a hard sheet such as an OHP sheet is fed from the manual sheet feeding portion 38 to form an image thereon, the sheet is not guided to the pass 42, i.e. the sheet leaving the fixing apparatus 40 is made to pass above the flapper 41, and discharged from the discharging roller 43 with the image bearing surface faced upward (face up).

In the case of a double side print mode in which images are formed on both surfaces of the sheet, the sheet having an image fixed on a first surface by the fixing apparatus 40 is made to pass above the flapper 41 and guided to the discharging roller 43, and after the rear end of the sheet leaves the flapper 41, the sheet is switched back and guided from the pass 42 to the double side conveying pass 39 by the flapper 41.

The sheet is fed from the double side conveying pass 39 to the transferring portion 34 again with the front surface and the rear surface reversed to transfer the toner image to a second surface, and the sheet is again introduced into the fixing apparatus 40 to fix the toner image to the second surface.

Thereafter, the sheet having images formed on both surfaces is discharged from the printer portion A to the finisher D side by the discharging roller 43 through a sheet discharging channel in the same manner as in the single side image formation mode described above.

The finisher D performs treatments such as a shift treatment, a binding treatment and punching. The finisher D is provided thereon with an inserter E, which feeds a cover sheet, an inserting sheet and the like to the finisher D. An alignment plate 44 moves at an angle perpendicular to a conveyance direction to discharge the sheet to the rearward or frontward on the tray 45 if the recording material is output in a shifted manner as in shift sort.

<Operation Panel>

Figure 2:
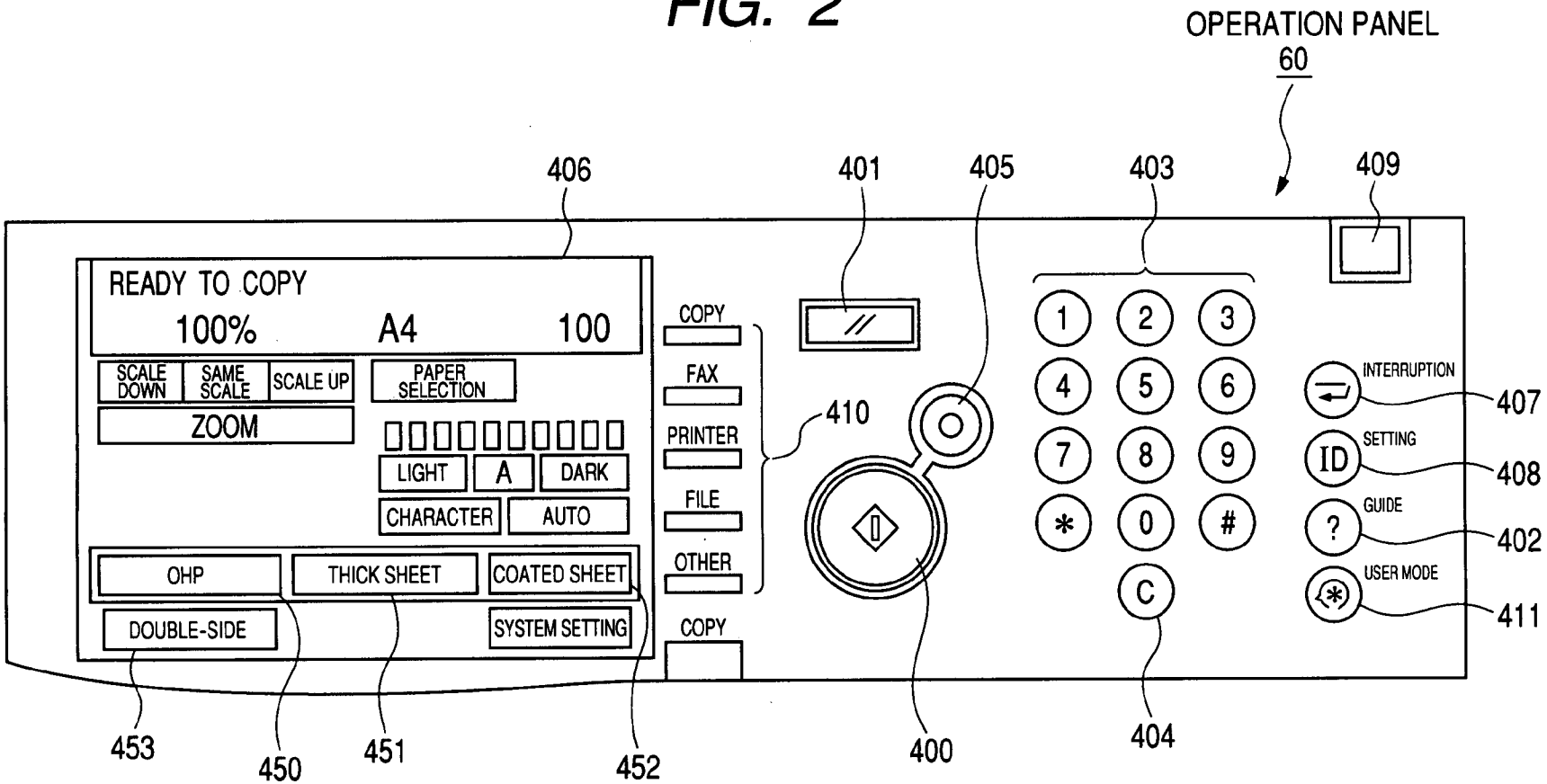
FIG. 2 is an outline view of an operation panel.

An operation panel as an operation portion for setting various kinds of modes by an operator will now be described. FIG. 2 shows the configuration of an operation panel 60 provided in the image forming apparatus. Reference numeral 400 denotes a copy start key for indicating the start of copy.

Reference numeral 401 denotes a reset key for returning the mode to the standard mode. Reference numeral 402 denotes a guidance key which is pressed down when a guidance function is used. Reference numeral 403 denotes a ten key for inputting a value such as a set number of sheets. Reference numeral 404 is a clear key for clearing a value. Reference numeral 405 denotes a stop key for stopping copy during continuous copy. Reference numeral 406 denotes a liquid crystal display portion displaying settings of various kinds of modes such as a staple mode, bookbinding mode or double side print setting and states of the printer, and a touch panel. Reference numeral 407 denotes an interruption key for interrupting continuous copy or an operation as a facsimile machine or printer to perform emergent copy. Reference numeral 408 denotes a secret identification key for managing the number of copied sheets for each individual or division. Reference numeral 409 denotes a soft switch for turning the power of the image forming apparatus main body ON/OFF. Reference numeral 410 denotes a function key which is used when the function of the image forming apparatus is changed. Reference numeral 411 denotes a user mode key for entering into a user mode in which a user sets an item in advance such as ON/OFF of an automatic cassette change or a change of set time until entrance into an energy saving mode.

Reference numerals 450 to 452 denote recording material type setting keys (means for setting a type of recording material to be used in image formation), which are keys for setting a transparency film for an overhead projector (hereinafter referred to as OHP), a thick sheet, and a resin coated sheet which is a sheet having a resin layer or layers on the front surface or front and rear surfaces. In this embodiment, the thick sheet is a recording material having a basic weight of 110 g/m$^2$ or greater. Reference numeral 453 denotes a key for performing double side print.

<Fixing Apparatus>

Figure 3:
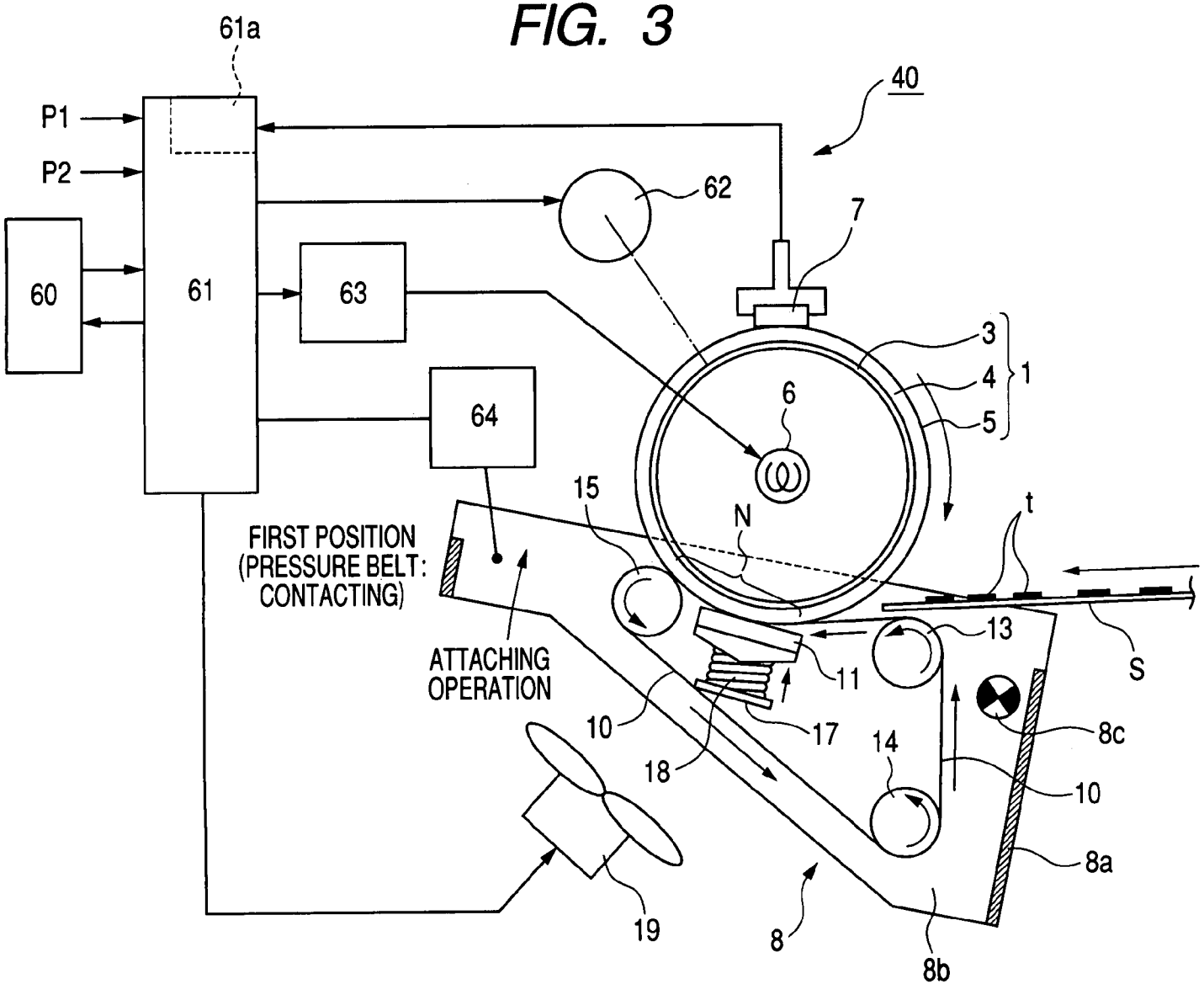
FIG. 3 is a model diagram of the general configuration of a fixing apparatus (pressure belt: contacting) and a block diagram of a control system.

FIG. 3 is a model diagram of the general configuration of the fixing apparatus 40 and a block diagram of a control system. The fixing apparatus 40 is a belt type hot-press fixing apparatus.

Reference numeral 1 denotes a fixing roller as a heating member (rotating member) including a heating source. The fixing roller 1 has a hollow core bar 3 covered with an elastic layer 4 such as a silicon rubber, and its surface is covered with a fluorine coated layer 5 as a release layer. A halogen lamp 6 being a heating source is placed in the fixing roller 1.

The fixing roller 1 has its both end portions so situated as to be rotatably supported between side plates (not shown) on the rearward and frontward sides of the fixing apparatus via a bearing member. Reference numeral 7 denotes a thermister as thermometry means for sensing the temperature of the surface of the fixing roller, which is so situated as to contact a portion of the surface of the fixing roller corresponding to a central portion of a sheet passage area.

Reference numeral 8 denotes a belt unit situated below the fixing roller 1. The belt unit 8 is an assembly of a unit frame member 8*a*, three rollers 13, 14 and 15 as belt stretching members so situated as to be bearing-wise supported rotatably in parallel with each other between side plates 8*b* on the rearward and front ward sides (side plate on the frontward side is not shown), an endless pressure belt 10 looped over the three rollers 13, 14 and 15, a pressure pad member 11 situated inside the pressure belt 10, and the like.

The side plates 8*b* on the rearward and frontward sides of the unit frame member 8*a* are pivotally supported on the side plates on the rearward and frontward sides of the fixing apparatus, respectively, whereby the belt unit 8 is so situated as to be supported vertically rockably around a pivot portion 8*c* with respect to the fixing roller 1 with the belt unit 8 placed between the side plates on the rearward and frontward sides of the fixing apparatus.

The pressure belt 10 is a heat-resistant resin material such as polyimide shaped into an endless belt.

Of the three rollers described above, the roller 13 is a roller on the recording material entrance side, and includes a heating source for heating the belt. The roller 14 is a tension roller tensioning the pressure belt 10, and the roller 15 is a recording material separating roller.

The pressure pad member 11 is aluminum shaped into a block, and is abutted against the inner surface of a portion of the pressure belt between the roller 13 on the recording material entrance side and the separating roller 15 by a lifting spring 18 provided between the backward side of the unit frame member 8*a* and a spring seat 17 provided on the side plate 8*b* on the frontward side.

The reference numeral 64 denotes a vertically rocking mechanism as contacting and separating means of the belt unit 8, and can be comprised of, for example, an electromagnetic solenoid-plunger mechanism, cam mechanism, lever mechanism or the like.

The vertical rocking mechanism 64 vertically rocks the belt unit 8 around the pivot portion 8*c* with respect to the fixing roller 1 under control by a control circuit portion (controlling means) 61.

Figure 4:
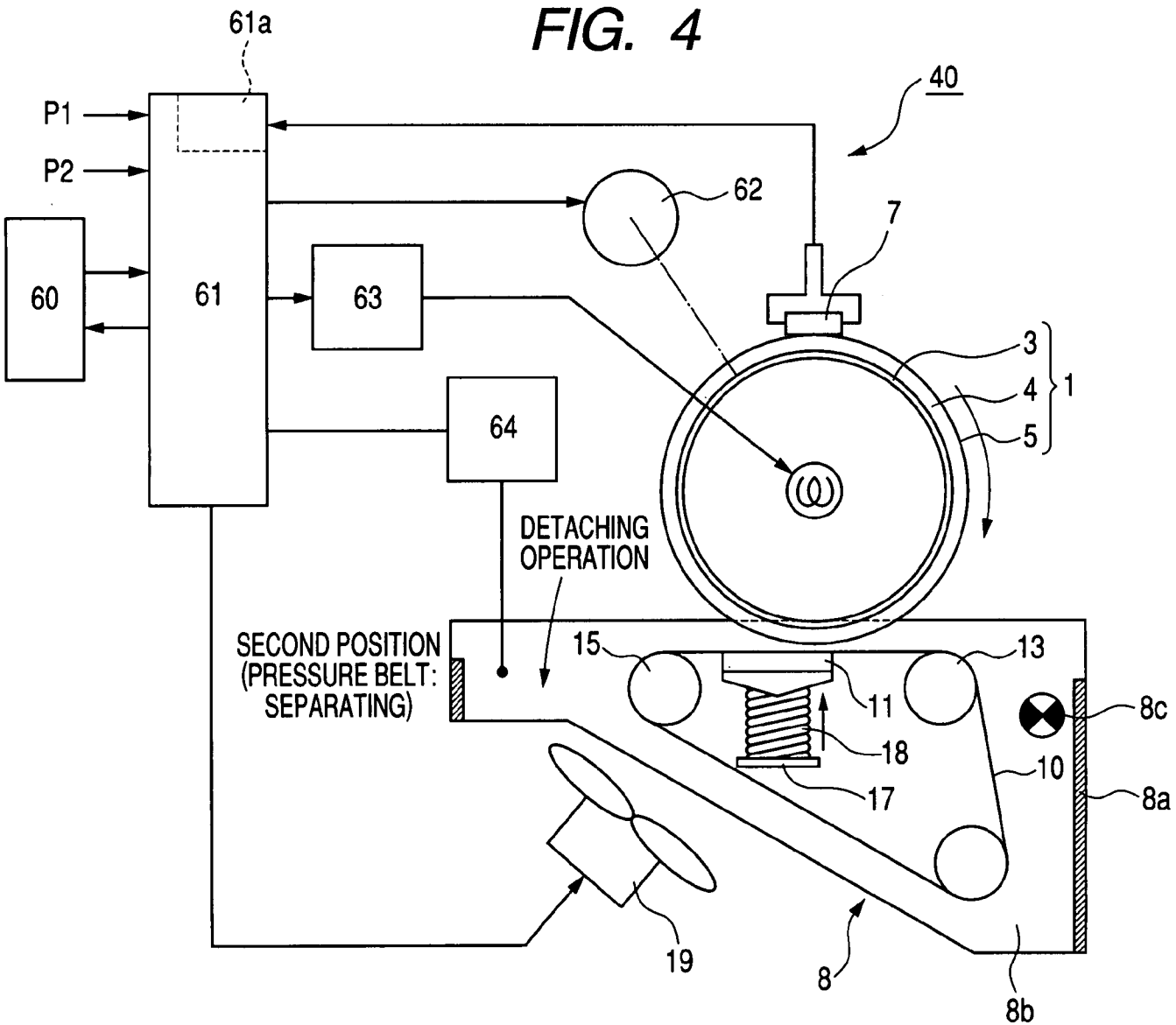
FIG. 4 is a model diagram of the general configuration of a fixing apparatus (pressure belt: separating) and a block diagram of a control system.

That is, the vertically rocking mechanism 64 allows switching between:

(1) a first position in which as shown in FIG. 3, the belt unit 8 is rotated in a lifting direction with respect to the fixing roller 1 to abut the separating roller 15 against the fixing roller 1 with the pressure belt 10 nipped therebetween, and the outer surface of a portion of the pressure belt between the separating roller 15 and the roller 13 on the recording material entrance side is made to contact the undersurface of the fixing roller 1 (attaching operation), and (2) a second position in which as shown in FIG. 4, the belt unit 8 is rotated in a lowering direction with respect to the fixing roller 1 to space the separating roller 15 and the pressure belt 10 from the undersurface of the fixing roller 1 (detaching operation).

The belt unit 8 vertically rockably around the pivot portion 8*c* with respect to the fixing roller 1 and the vertically rocking mechanism 64 of the belt unit 8 constitute a contacting and separating mechanism making the pressure belt 10 contact and be separated from the fixing roller 1.

In a state in which the belt unit 8 is in the first position as in FIG. 3, the separating roller 15 is abutted against the fixing roller 1 with the pressure belt 10 nipped therebetween, the outer surface of a portion of the pressure belt between the roller 13 on the recording material entrance side and the separating roller 15 contacts the undersurface of the fixing roller 1, and thus the belt pressure pad member 11 abuts the portion of the pressure belt against the undersurface of the fixing roller 1 with a compression reactive force of the spring 18, whereby a wide fixing nip portion N is formed between the fixing roller 1 and the pressure belt 10.

Fixing processing of an unfixed toner image t on the sheet S is carried out in the state in which the belt unit 8 is switched to the first position so that the fixing nip portion N is formed between the fixing roller 1 and the pressure belt 10.

That is, the fixing roller 1 is rotationally driven at a predetermined speed in the clockwise direction shown by the arrow by a driving apparatus 62 controlled by the control circuit portion 61. The pressure belt 10 dependently rotates in the counterclockwise direction shown by the arrow as the fixing roller 1 is rotationally driven.

Power is supplied from a power supply portion 63 to the halogen lamp 6 being a heating source of the fixing roller 1, and the fixing roller 1 is heated with radiation heat from the halogen lamp 6.

At this time, the surface temperature of the fixing roller 1 is sensed by the thermister 7, and the sensed temperature is input to a temperature adjustment circuit portion 61*a* of the control circuit portion 61 as an electric signal.

The temperature adjustment circuit portion 61*a* adjusts the temperature of the surface of the fixing roller 1 by controlling the power supply from the power supply portion 63 to the halogen lamp 6 so that an electric signal corresponding to the temperature of the fixing roller input from the thermister 7 is kept to be an electric signal corresponding to a predetermined temperature.

Power supplied to the heating source in the roller 13 is controlled so that the pressure belt 10 is heated by the heating source included in the roller 13, and thus the temperature of the pressure belt 10 is elevated to a predetermined temperature (set to a temperature lower than the temperature of the fixing roller to prevent the image defect described above) before a fixing operation is started. Even after the fixing operation is started, the power supplied to the heating source in the roller 13 is controlled so that the pressure belt 10 is kept at the predetermined temperature.

In the state in which the fixing roller 1 is rotationally driven, the pressure belt 10 dependently rotates, and the fixing roller 1 is heated by the halogen lamp 6 and thermally adjusted to have a predetermined fixing temperature, the sheet S bearing an unfixed toner image is introduced from the roller 13 on the recording material entrance side of the belt unit 8 to the fixing nip portion N, and nipped in conveyed in the fixing nip portion N. In this process of nipping and conveying the sheet S, the surface of the unfixed toner image on the sheet S is brought into intimate contact with the surface of the fixing roller 1, and the toner image is heated with heat from the fixing roller 1 and hot press-fixed on the surface of the sheet S. The sheet S is separated from the surface of the fixing roller 1 by invading (ingression) of the separating roller into the elastic layer 4 of the fixing roller 1 at a sheet exit portion of the fixing nip portion N, and then discharged and conveyed.

Reference numeral 19 denotes a fan as belt cooling means. The fan 19 will be described later.

<Fixing Control>

Figure 6:
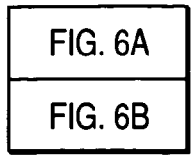
FIG. 6 is comprised of FIGS. 6A and 6B showing flowcharts of pressure belt detaching/attaching control in accordance with a distance between recording materials.
Figure 7:
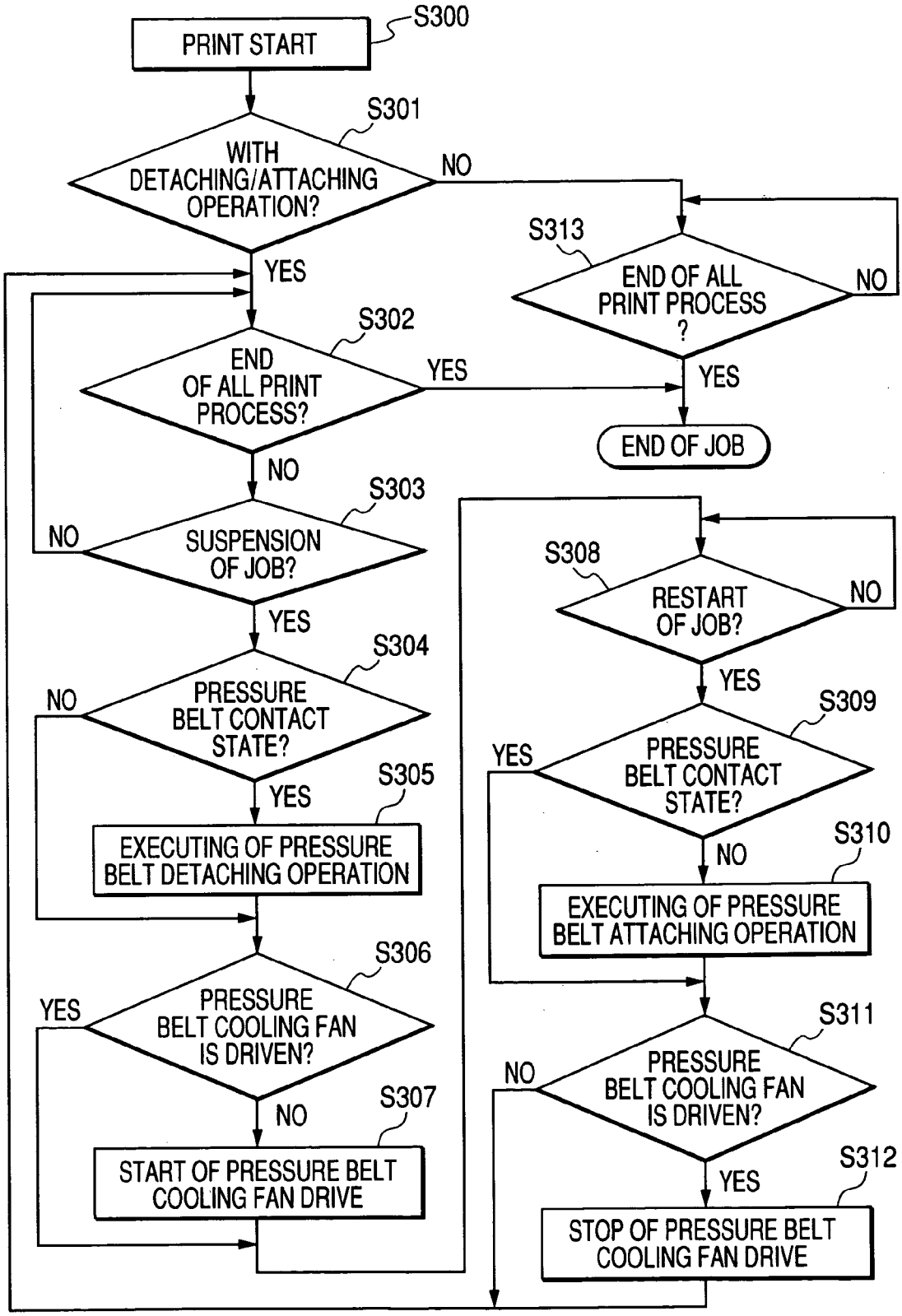
FIG. 7 is a flowchart of pressure belt detaching/attaching control in accordance with a state of a job.

Fixing control in the continuous image formation job for continuously forming images on a plurality recording materials will be described below using FIGS. 5 to 7. The sheet interval during the continuous image formation job is controlled to be kept at almost a predetermined value. That is, the image formation job in which the sheet interval is kept at almost a predetermined value is called a continuous image formation job. The following fixing control is executed by the control circuit portion 61 as control means.

Figure 5:
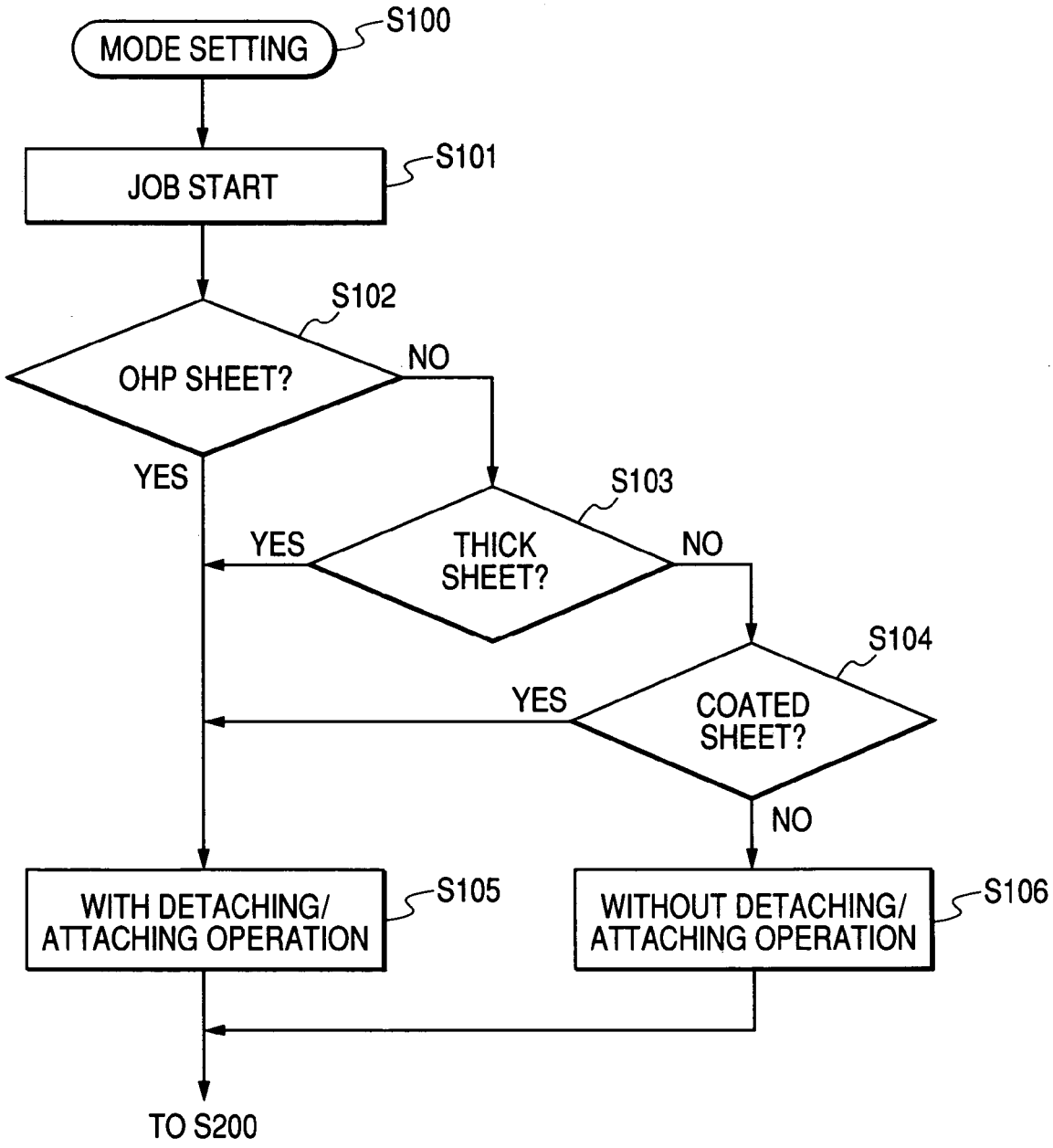
FIG. 5 is a flowchart of print mode determination.

The flowchart of FIG. 5 is a flowchart for determining whether a detaching/attaching operation of the detaching/attaching mechanism 64 is executed during the continuous image formation job or not (whether an operation for separating the pressure belt 10 from the fixing roller 1 is executed or not), in accordance with a type of recording material set by means for setting the type of recording material to be used in image formation.

At step S100, a mode of a job matching the type of recording material used is set by any one of an OHP sheet (optically transparent resin sheet) selection key 450, a thick sheet selection key 451 and a coated sheet (resin coated sheet) selection key 452, which are recording material type setting keys on the operation panel 60, or in combination of the keys. The combination of the keys implies, for example, a thick sheet and a thin sheet, wherein both the thick sheet key and coated sheet key are selected.

The thick sheet in this embodiment refers to a recording sheet having a basic weight of 110 g/m$^2$ or greater, the coated sheet refers to a recording sheet having the surface of the front surface or surfaces of the front and rear surfaces coated with a resin such as an acryl resin or polyolefin resin, the OHP sheet refers to an optically transparent resin, specifically a film composed of a polymer resin material.

The mode setting at step S100 is a step of setting a mode of a job matching the type of recording material used. Specifically, there are various kinds of job modes matching the type of recording material used, such as a job mode when the "OHP sheet" is selected, a job mode when the "thick sheet" is selected, a job mode when the "coated sheet" is selected, a job mode when the "normal sheet" is selected, and a job mode when the "thin sheet" is selected.

When the mode is determined, the conveyance speed of the recording material, the temperature of the fixing roller and the like set for each mode are changed. In this embodiment, if the conveyance speed of the recording material for the normal sheet (of which the basic weight is less than 110 g/m$^2$) is 1, the speed is set to ⅓ in consideration of fixing characteristics for the OHP sheet, the thick sheet and the resin coated sheet, and the sheet interval for the OHP sheet, the thick sheet and the resin coated sheet is inevitably longer than the sheet interval for the normal sheet.

At step S101, the copy start key 400 is pressed in the operation portion to start the image formation job. If the image forming apparatus is used as a printer by network-connecting a personal computer or the like to the image forming apparatus by a LAN cable, the image formation job is started by a print instruction from the personal computer or the like.

First, at step S102, whether the selected type of recording material is the OHP sheet or not is determined. If the OHP sheet is not set, processing proceeds to step S103. At step S103, whether the thick sheet is set or not is determined. If the thick sheet is not set, processing proceeds to step S104. At step S104, whether the coated sheet is set or not is determined.

If the coated sheet is not set, processing proceeds to step S106, where the type of recording material is judged to be the normal or thin sheet, it is thus determined that no detaching/attaching operation of the pressure belt 10 is executed in the sheet interval during the continuous image formation job, and the fixing roller and the pressure belt are kept abutted against each other during the continuous image formation job.

If it is determined that a relevant type of sheet is set at any one of steps S102 to 104, processing proceeds to step S105, where it determined that the detaching/attaching operation of the pressure belt 10 is executed in the sheet interval during the continuous image formation job.

The reason why "no detaching/attaching operation is executed" at step S106 for the normal or thin sheet is that the possibility of occurrence of an image defect due to a blister is principally small (depending on conditions such as the amount of toner carried, the content of water in the sheet and the like) even if the temperature of the pressure belt 10 is elevated in the case of the normal or thin sheet, and a reduction in life time of the detaching/attaching mechanism 64 due to frequent detaching/attaching operations should be prevented.

In this embodiment, the purpose is consists in determining whether the detaching/attaching operation of the pressure belt 10 is executed or not according to the set recording material, and the type of sheet for which the detaching/attaching operation is executed is not limited to the embodiment described above, but may be changed as required. That is, whether the detaching/attaching operation of the pressure belt 10 is executed or not may be determined according to whether the selected recording material is disposed to suffer an image defect such as a blister with elevation of the temperature of the pressure belt.

Figure 6A:
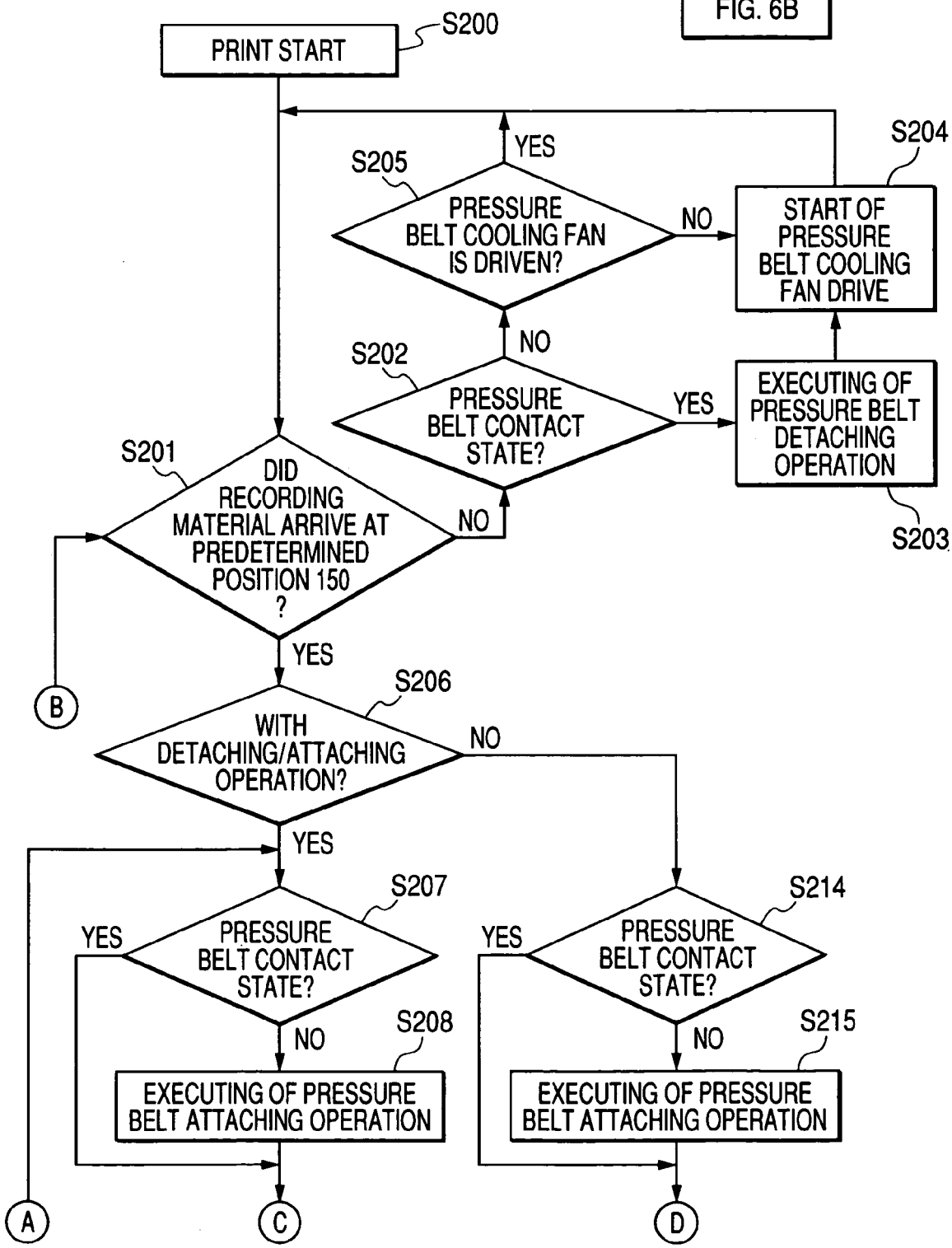

When whether the detaching/attaching operation is executed or not is determined, then processing proceeds to step S200 (FIG. 6A).

Figure 6B:
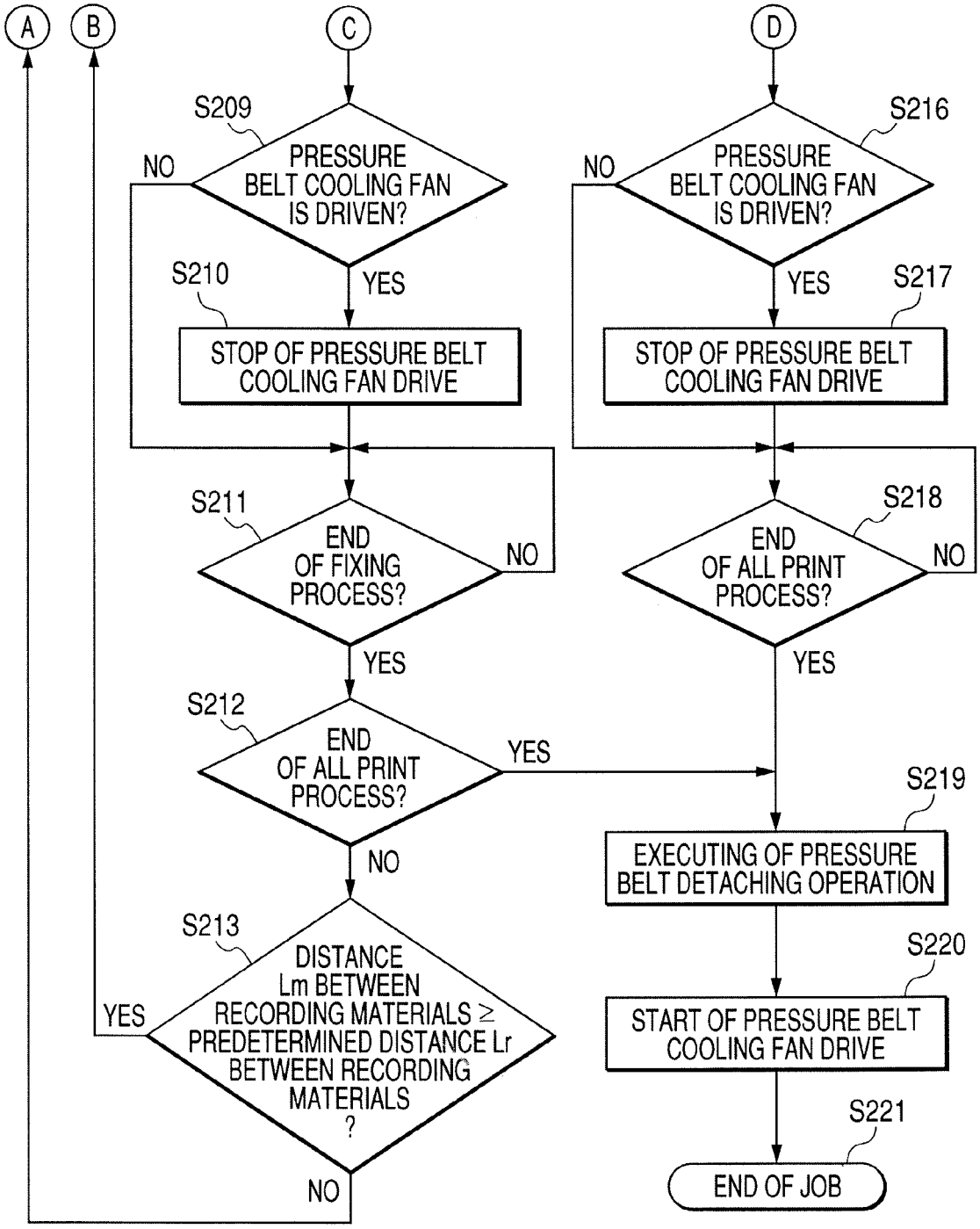

FIGS. 6A and 6B are flowcharts in which the control circuit portion 61 as control means executes pressure belt detaching/attaching control after the immediately preceding recording material passes through the fixing nip and before the subsequent recording material arrives at the fixing nip, i.e. in the sheet interval (distance between recording materials) during the continuous image formation job.

At step S200, print is started. The print implies a series of processes including formation of a latent image on a photosensitive member, development of the latent image, and transferring of the developed image to the recording material.

At step S201, whether the recording material S arrives at a predetermined position 150 (registration roller position in FIG. 1) is determined. This determination is made by a sheet existence/nonexistence sensing signal P1 (FIGS. 3 and 4) received by the control circuit portion 61 from a sheet sensor (not shown) sensing the arrival of the recording material, which is situated at the registration roller position, or a sheet feeding sequence.

If no recording material arrives, processing proceeds to step S202, where whether the pressure belt 10 contacts the fixing roller 1 is determined.

If the pressure belt contacts the fixing roller 1, a detaching operation of the pressure belt 10 is executed at step S203, drive of the pressure belt cooling fan 19 is started at step S204, and processing returns to step S201.

If the pressure belt is separated from the fixing roller, processing proceeds to step S205, and if the pressure belt cooling fan is not driven, the pressure belt cooling fan 19 is driven at step S204, and processing returns to step S201.

If the pressure belt cooling fan 19 is driven, then processing directly returns to step S201.

When the recording material arrives at the predetermined position 150 at step S201, processing proceeds to step S206.

That is, if no recording sheet S exists at the registration roller position 150 at a time when print is started, the pressure belt 10 is separated from the fixing roller 1 by the detaching operation (FIG. 4) until existence of the recording material is sensed, and the cooling fan 19 is driven to prevent elevation of the temperature of the pressure belt 10.

At step S206, the process is divided according to whether the detaching/attaching operation is executed or not as determined at steps S100 to S106.

First, the process will be described for the case where it is determined that the detaching/attaching operation of the pressure belt 10 is executed.

If the detaching/attaching operation is executed, whether the pressure belt 10 contacts the fixing roller 1 is determined at step S207.

If the pressure belt 10 does not contact the fixing roller 1, processing proceeds to step S208, where the attaching operation of the pressure belt 10 is executed for fixing an unfixed toner image on the recording material, and processing directly proceeds to step S209.

If the pressure belt 10 already contacts the fixing roller 1, processing proceeds to step S209.

At step S209, whether the pressure belt cooling fan 19 is driven is determined, if it is driven, drive of the pressure belt cooling fan 19 is stopped at step S210, and processing proceeds to step S211. If it is not driven, processing proceeds to step S211. If it is not driven, processing proceeds to step S211.

At step S211, passage of the recording material through the fixing nip, i.e. end of fixing process, is awaited.

If the fixing process is ended, whether all print process is ended is determined at step S212, and if it is determined it is ended, processing proceeds to step S219, and if it is determined that it is not ended, processing proceeds to step S213.

At step S213, a recording material distance Lm between the current sheet and the subsequent sheet is determined, and if Lm is equal to or greater than a predetermined distance Lr between recording materials, processing returns to step S201.

If the recording material distance Lm between the current sheet and the subsequent sheet is less than Lr at step S213, processing returns to step S207. In this case, the detaching operation of the pressure belt 10 in the sheet interval is not executed, and the pressure belt is kept abutted against the fixing roller.

Such a series of flows is repeatedly carried out until the continuous image formation job is ended, and if it is determined that the print process is ended at step S212, the pressure belt is separated from the fixing roller (S219), then drive of the cooling fan is started (S220), and a series of jobs is ended (S221).

Next, the process will be described for the case where it is determined that no detaching/attaching operation of the pressure belt 10 is executed at step S206.

If it is determined that no detaching operation is executed, whether the pressure belt 10 in a contact state is determined at step S214.

If it is determined that the pressure belt 10 is in a contact state, processing proceeds to step S216.

if it is determined that the pressing belt 10 is not in a contact state, processing proceeds to step S215 and the attaching operation of the pressure belt 10 is executed for carrying out fixing process, and processing proceeds to step S216.

At step S216, whether the pressure belt cooling fan 19 is driven is determined, and if it is driven, drive is stopped at step S217, and processing proceeds to step S218, and if it is not driven, processing directly proceeds to step S218.

Then, end of all print process is awaited at step S218. In the meantime, the detaching operation of the pressure belt is not executed regardless of the distance between recording materials.

When all print process is ended, the detaching operation of the pressure belt 10 is executed at step S219, the pressure belt cooling fan 19 is driven at step S220, and the job is ended at step S221.

For either the case where it is determined that the detaching/attaching operation of the pressure belt 10 is executed, or the case where it is determined that no detaching/attaching operation is executed, the detaching operation of the fixing roller 1 and the pressure belt 10 is executed, and the pressure belt 10 is cooled is cooled by the pressure belt cooling fan 19 (S219, S220) during a standby period until the next job, whereby unnecessary supply of heat from the fixing roller 1 to the pressure belt 10 is avoided and at the same time, the pressure belt 10 can be cooled, thus making it possible to prevent unnecessary elevation of the temperature of the pressure belt. if a next job start signal is input during the standby mode, the mode returns from the standby mode to the normal mode, and the image formation job described above is started.

As in the process described above, in the case a sheet such as an OHP sheet, thick sheet or coated sheet which is disposed to suffer an image defect such as a blister due to elevation of the temperature of the pressure belt 10, the detaching/attaching operation of the fixing roller 1 and the pressure belt 10 is executed in the sheet interval even during the continuous image formation job, whereby unnecessary supply of heat from the fixing roller 1 to the pressure belt 10 is prevented, thus making it possible to prevent occurrence of an image defect such as a blister.

Thus, it is possible to prevent a degradation in image quality when the continuous image formation job is in progress. In other words, high quality images can be continuously formed during the continuous image formation job.

Detaching/attaching control when some abnormal event making it impossible to continue formation of images occurs in the image forming apparatus during the image formation job, and therefore the image formation job is interrupted will now be described using the flowchart of FIG. 7. The detaching/attaching control is executed by the control circuit portion 61.

After print is started at step S300, the process is divided according to whether the detaching/attaching operation is executed or not as determined at steps S100 to S106, at step S301.

if no detaching/attaching operation is executed, end of all print process is awaited at step S313, and the job is ended at step S313.

At this time, detaching/attaching control of the pressure belt 10 is not executed regardless of the state of the job.

If it is determined at step S301 that detaching/attaching control is executed, determination on whether the job is stopped is awaited at step S303.

Interruption of the job in this embodiment is caused by, for example, no sheet in a sheet feeding cassette as a recording material containing portion, toner shortage (no toner) in a developing device, a jam of the recording material in a recording material conveying channel, or the like. The abnormal state of the image forming apparatus is not limited to the above embodiments, but may be appropriately set as required as long as it is an event making it impossible to continue formation of images.

In FIGS. 3 and 4, reference symbol P2 denotes a no sheet signal, toner shortage signal, jam sensing signal or the like which is input to the control circuit portion 61. The control circuit portion 61 interrupts the job when the signal P2 is input thereto.

If it is determined that the job is interrupted, the contact state of the pressure belt is examined at step S304, and if it is in a separating state, processing proceeds to step S306, and if it is in a contact state, the detaching operation of the pressure belt 10 is executed at step S305.

Then, the drive state of the pressure belt cooling fan 19 is examined at step S306, and if it is driven, processing proceeds to step S308, and if it is not driven, the pressure belt cooling fan is driven at step S307.

At step S308, the restart of the job is awaited, and if the job is restarted, again at step S309 the contact state of the pressure belt 10 is examined, and the drive state of the pressure belt cooling fan is examined at step S311, and if the pressure belt 10 is in a separating state, the attaching operation is executed in step S310, and if the pressure belt cooling fan 19 is driven, the drive is stopped in step S312, and processing returns to step S302.

As described above, even if some abnormal event occurs at a location other than the fixing apparatus in the image forming apparatus, i.e. regardless of the location at which the abnormal event occurs in the image forming apparatus, the separating operation of the pressure belt 10 is executed during a period after the temporary interruption of the image formation job and before the restart of the image formation job, whereby unnecessary elevation of the temperature of the pressure belt 10 is prevented, thus making it possible to prevent a degradation in quality of images formed after the restart of the image formation job due to the blister or the like.

Embodiment 2

Figure 8:
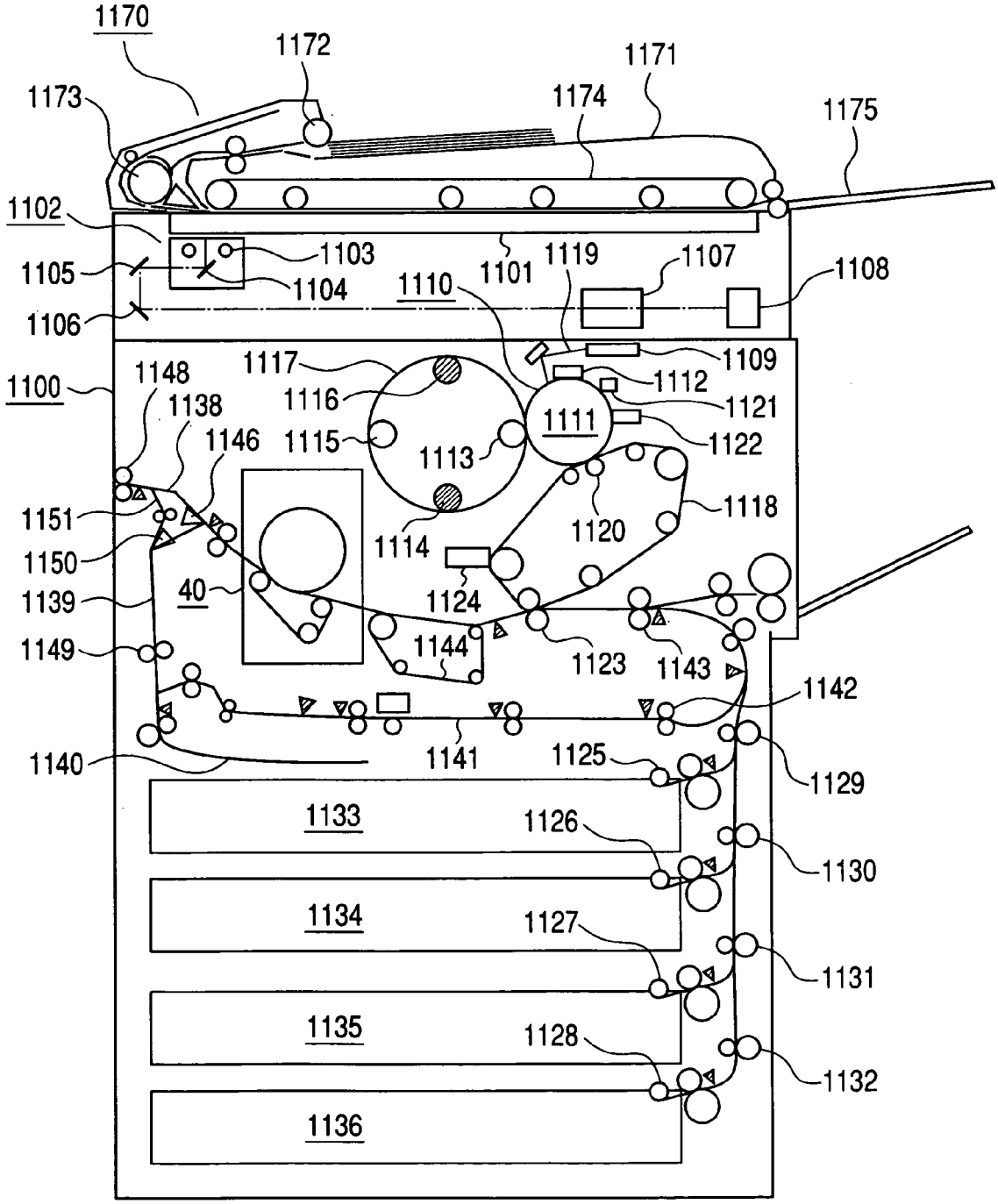
FIG. 8 is a sectional view of image forming apparatus main body representing a second embodiment of the present invention.

FIG. 8 shows an image forming apparatus capable of forming full color images, to which the present invention can be applied as in Embodiment 1. In this embodiment, devices for forming images (unfixed images) on the recording material are collectively referred to as image forming means, and various devices constituting the image forming means will be described in detail below.

In FIG. 8, reference numeral 1100 denotes an image forming apparatus main body, and reference numeral 1101 denotes a platen glass as an original placement table. Reference numeral 1102 denotes a scanner, which is comprised of an original illuminating lamp 1103, a scan mirror 1104 and the like. The scanner 1102 reciprocally scans in a predetermined direction by means of a motor (not shown). During the reciprocal scanning, light reflected from the original passes through a lens 1107 via scan mirrors 1104 to 1106, and an image on the original is formed on a CCD sensor in an image sensor 1108.

Reference numeral 1170 denotes an automatic original feeding apparatus (AutoDocumentFeeder, hereinafter referred to as ADF), which automatically feeds the original to a position in which the original can be read with the scanner 1102. Reference numeral 1171 denotes an original placement table of the ADF, on which an original of maximum 100 sheets can be placed. Reference numeral 1172 denotes an original sheet feeding roller for feeding the original in the ADF. Reference numeral 1173 denotes an original double side reversing roller for reading both surfaces of the original fed from the original sheet feeding roller 1172. It is an original conveying belt 1174 that conveys onto the platen glass 1101 the original conveyed from the original sheet feeding roller 1172 or original double side reversing roller 1173, and the original conveying belt 1174 is controlled to stop the original at a reading position, convey the original back to the original double side reversing roller 1173 when the rear surface of the original is read, and convey the original for discharging it to an original discharging port 1175. For the original discharging port 1175, the maximum number of sheets placed is 100 or greater as in the case of the original placement table 1171.

Reference numeral 1109 denotes an exposure controlling portion comprised of a laser, a polygon scanner and the like. The exposure controlling portion 1109 irradiates a photosensitive drum 1111 as an image bearing member facing an image formation area 1110 with laser light 1119 modulated based on an image signal converted into an electric signal at the image sensor portion 1108 and subjected to predetermined image processing described later.

Around the photosensitive drum 1111, a pre-exposing lamp 1121 for eliminating a potential on the photosensitive drum 1111, a primary charging device 1112 causing corona discharge by applying a high voltage to a wire for loading a potential on the photosensitive drum 1111, and developing devices 1113 to 1116 filled with toners developing an image formed latently in an electrostatic manner by the laser light 1119 on the photosensitive drum 1111 are contained, and a developing rotary 1117 moving the developing devices 1113 to 1116 one after another so as to contact the photosensitive drum 1111, a primary transferring roller 1120 transferring the image to an intermediate transferring member 1118 temporarily holding the image developed on the photosensitive drum 1111, and a cleaning apparatus 1122 are placed.

The photosensitive drum 1111 is rotated by a motor (not shown), charged to a predetermined potential by the primary charging device 1112, and then irradiated with laser light 1119 from the exposure controlling portion 1109. As a result, an electrostatic latent image is formed on the photosensitive drum 1111. The developing device 1113 of a first color is moved by the developing rotary 1117 so that the developing device 1113 contacts the photosensitive drum 1111, and thereby a toner in the developing device 1113 is electrostatically stuck to the electrostatic latent image, whereby a toner image developed on the photosensitive drum 1111 can be formed.

If a full color image is formed with toners of developing devices of four colors contained in the developing rotary 1117, the toner image of the first color developed on the photosensitive drum 1111 is temporarily transfeffed to the intermediate transfeffing member 1118 as a transferring medium by the primary transfeffing roller 1120, and the developing device 1114 of a second color is made to contact the photosensitive drum 1111 by the developing rotary 1117. At this time, just when the leading end of the developed image of the first color primarily transferred to the intermediate transferring member 1118 completely matches the leading end of the developed image of the second color to be developed on the photosensitive drum 1111 at the position of the primary transferring roller 1120, an electrostatic latent image is formed by the laser light 1119 applied from the exposure controlling portion 1109. Then, the developed image of the second color is superimposed on the developed image of the first color primarily transferred on the intermediate transferring member 1118.

The superimposition is repeated for a third color and a fourth color, whereby a full color developed image of four colors is transferred onto the intermediate transferring member 1118.

A recording sheet fed from a first sheet feeding cassette 1133, second sheet feeding cassette 1134, third sheet feeding cassette 1135 or fourth sheet feeding cassette 1136 by a pickup roller 1125, 1126, 1127 or 1128 is conveyed toward a registration roller 1143 by a sheet feeding 1129, 1130, 1131 or 1132. The unfixed toner image formed on the intermediate transferring member 1118 is bias-transferred to a secondary transferring roller 1123, the registration roller 1143 is driven so that the leading end of the image matches the leading end of the sheet, and thus the image is transferred onto the recording sheet conveyed to near the registration roller 1143 at a standstill. Then, the sheet is fed to a conveying belt 1144.

In the intermediate transfeffing member 1118, a residual toner which has not been transfeffed to the sheet by the secondary transferring roller 1123 remains, and cleaning is started by an intermediate transferring member cleaner 1124. The intermediate transferring member cleaner 1124 is detachably attachable, and is controlled so that it contacts the intermediate transferring member 1118 just before the leading end of the residual toner of the secondarily transferred image arrives at the intermediate transferring member cleaner 1124, and departs from the intermediate transfeffing member 1118 when the image of the first color of the unfixed toner image is transfeffed to the intermediate transfeffing member 1118 by the primary transferring roller 1120 and the leading end of the image comes just in front of the intermediate transferring member cleaner 1124.

For the image transferred to the intermediate transferring member 1118 by the primary transferring roller 1120, a residual toner remains on the photosensitive drum 1111, which is cleaned by a photosensitive drum cleaner apparatus 1122. Then, a residual charge on the photosensitive drum 1111 is eliminated by the per-exposing lamp 1121.

The recording sheet is conveyed to the fixing device 40 by the conveying belt 1144. The toner image transferred to the recording sheet is pressured and heated to be fixed by the fixing device 40. Then, the recording sheet is discharged to outside the image forming apparatus main body 1100 by an inside discharging roller and an outside discharging roller 1148.

In FIG. 8, reference numeral 1146 denotes a sheet discharging flapper, which switches the traveling course of the recording sheet to one of a conveying channel 1138 and a discharging channel 1139. For double side recording (double side copy) in which images are formed on both surfaces of the recording sheet, the sheet discharging flapper 1146 is lifted upward, whereby the recording sheet fed from the inside discharging roller 1147 is made to enter the reverse channel 1139 from the conveying channel 1138 on a temporary basis, and then the traveling direction is reversed to convey the recording sheet into a double side reversing channel 1140. Thus, the recording sheet is guided into a sheet refeeding channel 1141 in a reversed state. Reference numeral 1142 denotes a sheet refeeding roller refeeding the recording sheet to an image formation area 1110.

Reference numeral 1148 denotes an outside discharging roller which is placed near the sheet discharging flapper 1146 and discharges to outside the image forming apparatus main body 1100 the recording sheet of which the traveling course has been switched to the discharging channel 1139 side by the sheet discharging flapper 1147. When the recording sheet is reversed and discharged from the image forming apparatus main body 1100, the sheet discharging flapper 1150 is lifted upward, and the recording sheet is fed into the reverse channel 1139 up to a position in which the rear end of the recording sheet just passes through the reversing flapper 1150 by the reversing roller 1149. Then, the reversing roller 1149 is reversely rotated, whereby the recording sheet is reversed and fed through a reverse outside feeding channel 1151 to the discharging roller 1148 side.

Image formation modes will now be described. If a full color image is formed, it is necessary to rotate the intermediate transferring member 1118 four times to superimpose images of respective colors on one another for forming a full color image as described previously in the case of the image forming apparatus forming an image using one photosensitive member as in this embodiment.

In this case, the number of images which can be formed on the intermediate transferring member 1118 is determined by the peripheral length of the intermediate transferring member.

The intermediate transferring member 1118 in this embodiment has a size of Φ168, wherein images having sub scanning lengths (along the periphery of the intermediate transferring member) of 472 mm or less in consideration of a time period over which the developing device is switched by the developing rotary. For images having sub scanning lengths of 236 mm, half of 472 mm, or less, images of two pages can be formed on the intermediate transferring member 1118.

Here, an image formation mode in which images having sub scanning lengths of 236 mm or less are continuously formed multiple times is called "two sheets attachment", and an image formation mode in which images having sub scanning lengths greater than 236 mm and equal to or less than 472 mm are continuously formed multiple times is called "one sheet attachment".

Figure 9:
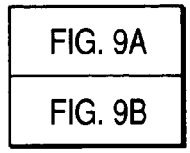
FIG. 9 is comprised of FIGS. 9A and 9B showing flowcharts of pressure belt detaching/attaching control in accordance with an image formation mode.
Figure 9A:
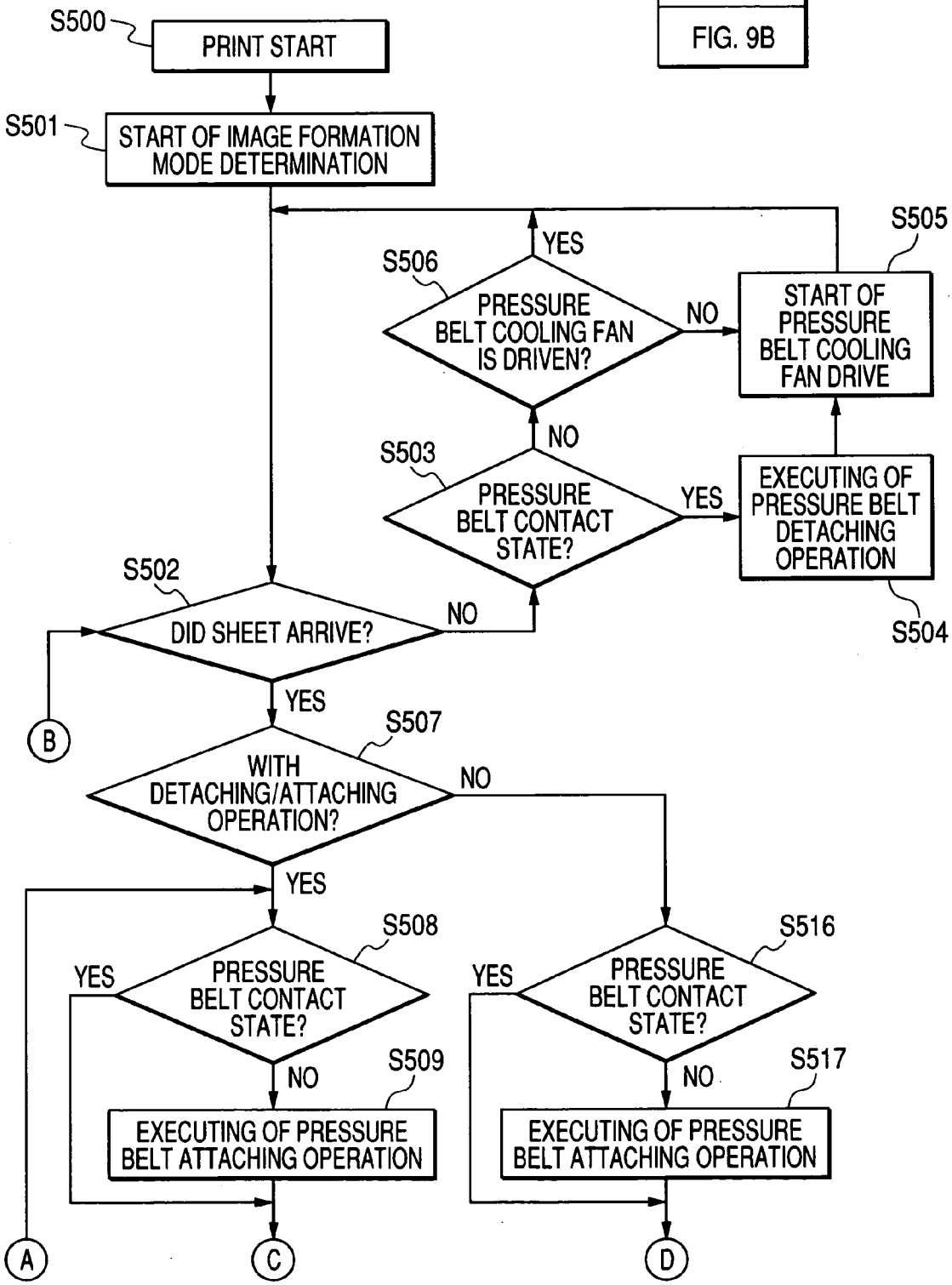
Figure 9B:
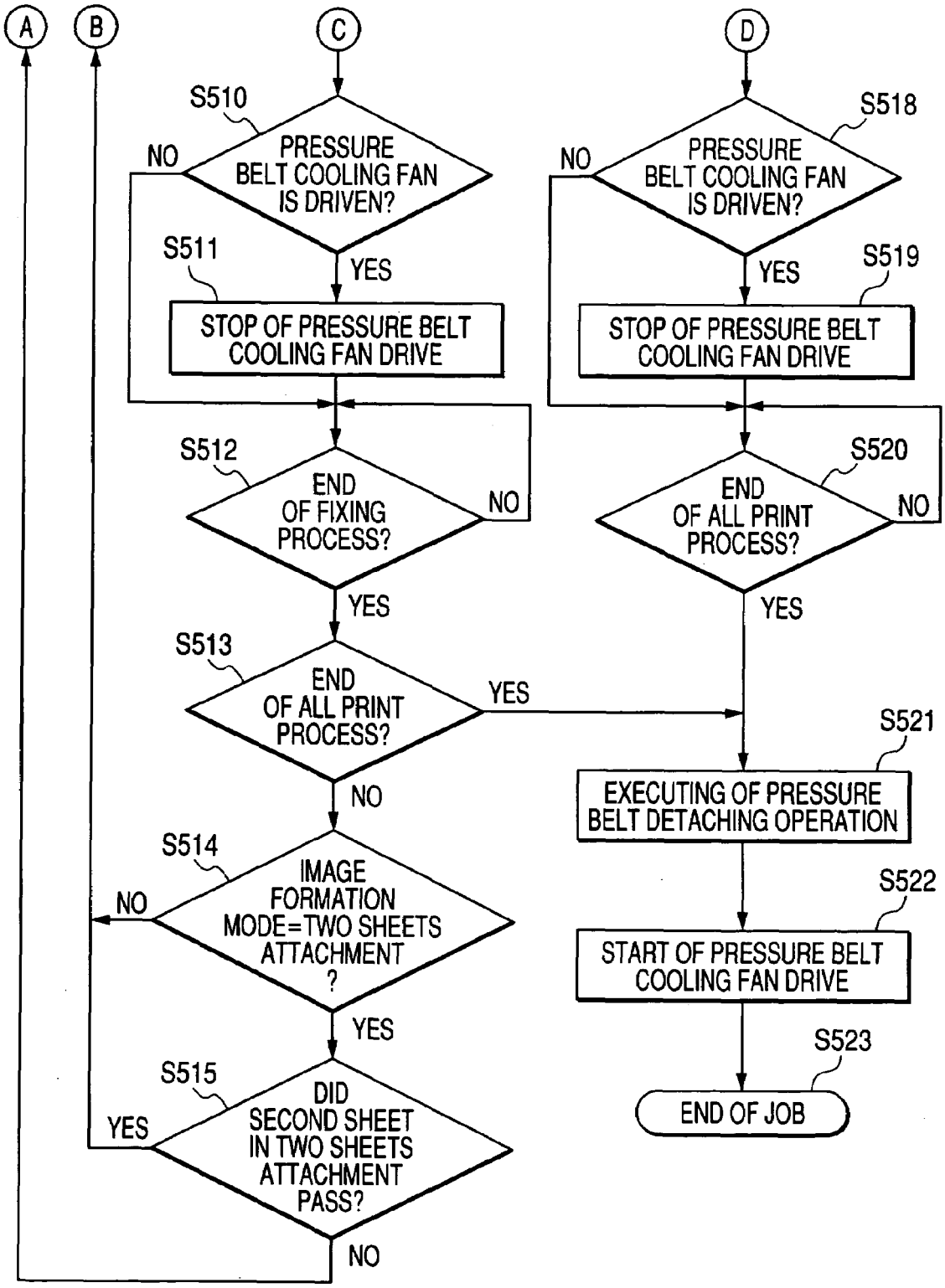

FIGS. 9A and 9B are flowcharts for executing detaching/attaching control during formation of a full color image. Details thereof will be described below. Formation of an image of a black plain color in this embodiment is same as that of Embodiment 1 described above.

At step S500, print is started. Print implies a series of processes including latent image formation, development and transferring as described in Embodiment 1.

First, at step S501, processing proceeds to step S600, where the image formation mode is set. The flow of step S600 and subsequent steps will be described later.

At step S502, whether the recording material (sheet) arrives at the position of the registration roller 1143 or not is determined. If no recording material is at the position, processing proceeds to step S503, where whether the pressure belt 10 contacts the fixing roller 1 is determined.

If the pressure belt contacts the fixing roller, the detaching operation of the pressure belt is executed at step S504, drive of the pressure belt cooling fan 19 is started at step S505, and processing returns to step S502.

if the pressure belt is separated from the fixing roller, processing proceeds to step S506, and if the pressure belt cooling fan is not driven, the pressure belt cooling fan is driven at step S505, and processing returns to step S502. If the pressure belt cooling fan 19 is driven, processing directly returns to step S502.

When the recording material arrives at the position of the registration roller 1143, processing proceeds to step S507. At step S507, the process is divided according to whether the detaching/attaching operation is executed or not as determined at steps S100 to S106.

The process will be described for the case where it is determined that the detaching/attaching operation of the pressure belt 10 is executed.

If the detaching/attaching operation is executed, whether the pressure belt 10 contacts the fixing roller 1 is first determined at step S508. If it does not contact the fixing roller 1, processing proceeds to step S509, where the attaching operation of the pressure belt 10 is executed, and processing returns to step S510.

if the pressure belt already contacts the fixing roller, processing directly proceeds to step S510. At step S510, whether the pressure belt cooling fan 19 is driven is determined, if it is driven, drive of the pressure belt cooling fan 19 is stopped at step S511, and processing proceeds to step S512. If it is not driven, processing proceeds to step S512.

At step S512, end of fixing process is awaited. When the fixing process is ended, whether all print process is ended is determined at step S513, and if it is determined that all print process is ended, processing proceeds to step S521, and if all print process is not ended, processing proceeds to step S514.

At step S514, the image formation mode set at step S600 is determined.

Here, if it is determined that the mode is "two sheets attachment", processing proceeds to step S515.

If the image formation mode is "two sheets attachment", whether the second sheet in two sheets attachment has passed through the fixing nip is determined. If it has not passed yet, processing returns to step S508.

If the mode is "two sheets attachment", two sheets pass through the fixing apparatus 40 in a rapid succession, and therefore the detaching operation of the pressure belt 10 is not executed in the sheet interval between the first and second sheets in "two sheets attachment", but the detaching operation of the pressure belt 10 is executed during a time period after the second sheet in "two sheets attachment" passes through the fixing nip and before the first sheet of recording material in "two-sheets attachment" (third sheet in the image formation job) arrives at the fixing nip. That is, each time two sheets of recording material in "two sheets attachment" pass through the fixing nip, the detaching operation of the pressure belt 10 is executed in the sheet interval. Then, processing returns to step S502 with the pressure belt separated from the fixing roller.

In this way, instead of executing the separating operation of the pressure belt one after another in all sheet intervals, the separating operation is executed in the sheet interval between the current recording material and the subsequent recording material each time a predetermined number of pass through the fixing nip.

At step S514, it is determined that the image formation mode is not "two sheets attachment", but hence "one sheet attachment", processing returns to step S502. At this time, as in Embodiment 1, the separating operation of the belt is executed one after another during a time period after the recording material passes through the fixing nip and before the subsequent recording material arrives at the fixing nip. That is, the separating operation of the pressure belt is executed one after another in all sheet intervals during the continuous image formation job.

The process will now be described for the case where detaching/attaching operation of the pressure belt 10 is not executed. If it is determined that no detaching/attaching operation is executed, whether the pressure belt 10 is in a contact state is determined at step S516, and if it determined that the pressure belt 10 is in a contact state, processing proceeds to step S518.

if it is determined that the pressure belt 10 is not in a contact state, the attaching operation of the pressure belt 10 is executed at step S517, and processing proceeds to step S518. At step S518, whether the pressure belt cooling fan 19 is driven is determined, and if it is driven, the drive is stopped at step S519, and if it is not driven, processing directly proceeds to step S520.

Then, end of all print process is awaited at step S520. In the meantime, the detaching operation of the pressure belt is not executed regardless of the distance between recording materials. When all print process is ended, the detaching operation of the pressure belt 10 is executed at step S521, the pressure belt cooling fan 19 is driven at step S522, and the job is ended at step S523.

As the process described above, the detaching/attaching operation of the fixing roller 1 and the pressure belt 10 is executed in one image formation job, and the pressure belt 10 is cooled by the pressure belt cooling fan 1-7 when the pressure belt 10 is in a detached state, whereby unnecessary supply of heat from the fixing roller 1 to the pressure belt 10 is prevented and at the same time, the pressure belt 10 can be cooled, thus making it possible to prevent unnecessary elevation of the temperature of the pressure belt 10.

Figure 10:
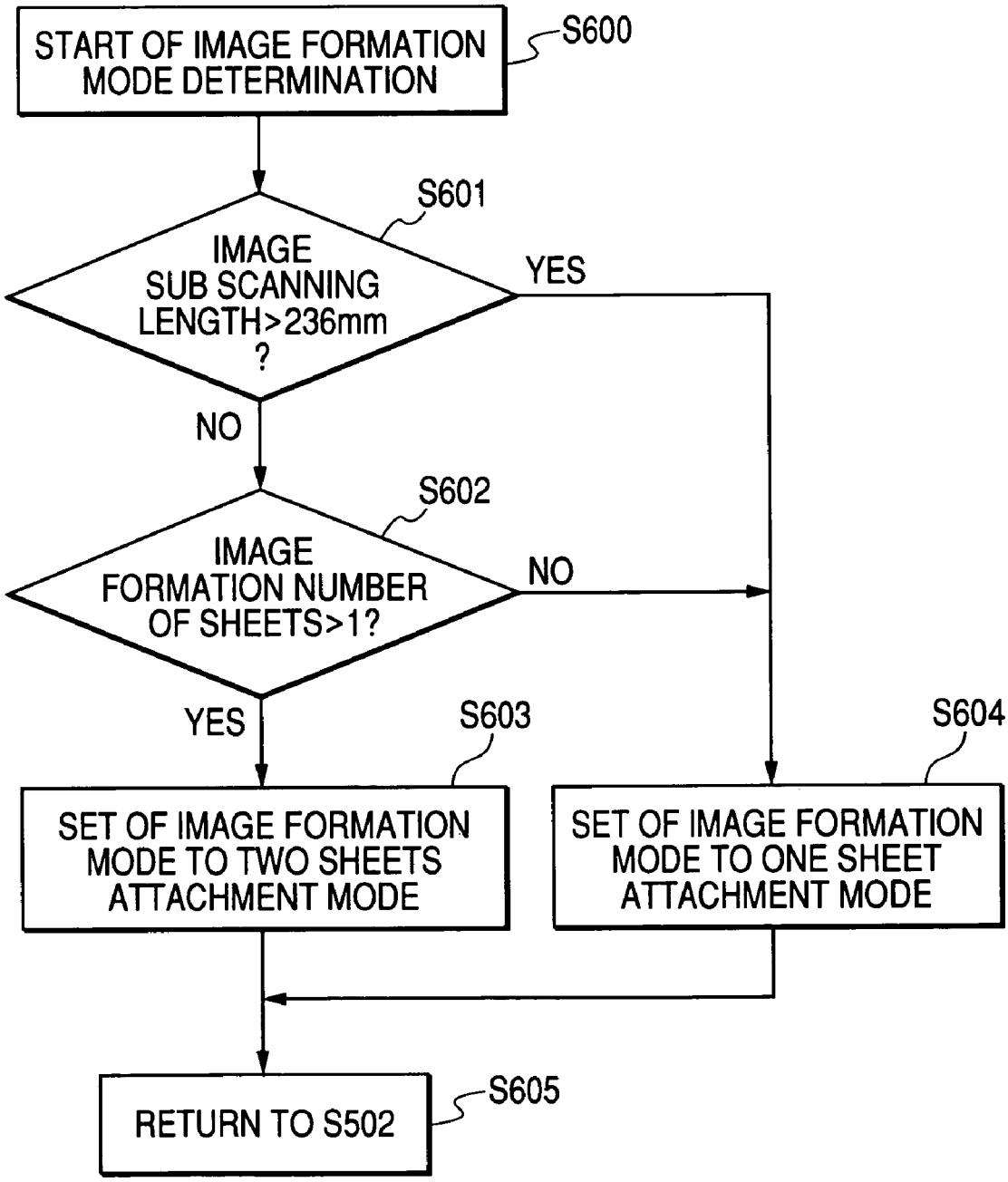
FIG. 10 is a flowchart of image formation mode determining means.

Image formation mode determining means in this embodiment will now be described using FIG. 10. when processing proceeds from step S501 to step S600, the sub scanning length of an image for which image formation process is executed is determined at step S601. As described above, the intermediate transferring member in this embodiment has a peripheral length permitting the two sheets attachment mode if the sub scanning length of the recording material is 236 mm or less.

Accordingly, whether the sub scanning length is 236 mm or less is determined. If it is determined that the length is 236 nm or less, processing proceeds to step S602.

At step S602, the number of sheets for which image formation process is executed is determined, If it is determined that the image formation process number of sheets for the recording material in this image formation job is 2 or greater, the image formation mode is set to the 2 sheets attachment mode in step S603, and processing proceeds to step S605 where it returns to step S502.

If it is determined at step S601 that the sub scanning length is greater than 236 mm, or if it is determined at step S602 that the image formation process number of sheets in this image formation job is 1, the image formation mode is set to the one sheet attachment mode for each case at step S604, and processing returns to step S502.

The present invention can be applied not only to the image forming apparatus forming full color images with toners of four colors of yellow, magenta, cyan and black, but also equally to the image forming apparatus forming full color images using dark color toners and light color toners of same hues and different densities in combination. For example, in the case of the apparatus forming full color images using six kinds of toners of yellow, dark magenta, light magenta, dark cyan, light cyan and black, the intermediate transferring member must be rotated at least six times, the sheet interval described above therefore tends to be longer, and therefore the effect by application of the present invention is significant.

Alternative Embodiment

1) In the Embodiments 1 and 2 described above, the sheet type of recording material to be passed is manually set by the operator in a setting portion for setting the type of recording material (if the operator provides no setting instruction, the type of recording material is recognized as a normal or thin sheet, and image formation is executed), but sheet type automatically sensing means for automatically sensing the sheet type of recording material passed may be provided to automatically set the sheet type.

2) The configuration in which the fixing roller 1 is heated is not limited to an inside heating system in which heating means is placed inside the fixing roller for heating as in the embodiments described above, but may employ an outside heating system in which heating means is placed outside the fixing roller for heating, and an combination of inside heating and outside heating systems. Furthermore, the fixing roller itself may be made to generate heat by an electromagnetic induction heating system.

3) The detaching/attaching mechanism making the pressure belt 10 contact and be separated from the fixing roller 1 is not limited to the configuration of the embodiments described above, but may be arbitrarily configured.

4) The belt heating means is not limited to the configuration like the fan 19, but may be, for example, a cooling apparatus using a heat dissipating fin, heat pipe or the like contacting the belt to remove heat.

5) The fixing apparatus of this embodiment may include an image heating apparatus provisionally fixing an unfixed toner image on the recording material, and an image heating apparatus for reheating the image provisionally fixed on the recording material to change the glossiness of the image.

6) The configuration of image forming means for forming an image on the recording material is not limited to the electrophotographic system described above, but may be any configuration of various kinds of image formation principles/processes such as electrostatic recording and magnetic recording.

According to the embodiments described above, a degradation in image quality when the continuous image formation job is in progress can be prevented.

This application claims priority from Japanese Patent Application No. 2004-105247 filed on Mar. 31, 2004, which is hereby incorporated by reference herein.

What is claimed is:

1. An image forming apparatus comprising:

image forming means for forming an image on a recording material;

a heating member for heating the image formed on the recording material at a nip portion;

an endless belt for forming said nip portion with said heating member therebetween;

contacting and separating means for bringing said heating member and said belt into the contact with each other and for separating said heating member and said belt from each other; and control means for controlling, in accordance with a type of recording material, to separate or not to separate said heating member and said belt from each other by said contacting and separating means during a time period after the immediately preceding recording material passes through said nip portion and before the subsequent recording material arrives at said nip portion when images are continuously formed on a plurality of recording materials.

2. The apparatus according to claim 1, further comprising changing means for changing the duration of said time period according to the type of recording material.

3. The apparatus according to claim 2, wherein when the duration of said time period is at least a predetermined time, said controlling means separates said heating member and said belt from each other, and if the duration of said time period is less than predetermined time, said controlling means controls to keep said heating member and said belt contacting with each other.

4. The apparatus according to claim 3, wherein if the basic weight of recording material is at least 110 $g/m^2$, said controlling means controls to separate said heating member and said belt from each other, and if the basic weight of recording material is less than 110 $g/m^2$, said controlling means controls to keep said heating member and said belt contacting with each other.

5. The apparatus according to claim 3, wherein if the recording material is an optically transparent resin or if the recording material is a resin coated sheet, said controlling means controls to separate said heating member and said belt from each other.

6. The apparatus according to claim 1, comprising cooling means for cooling said belt when said heating member and said belt are separated.

7. The apparatus according to claim 1, wherein said heating member contacts the image on the recording material at said nip portion.

* * * * *

UNITED STATES PATENT AND TRADEMARK OFFICE

CERTIFICATE OF CORRECTION

PATENT NO. : 7,283,759 B2
APPLICATION NO. : 11/085548
DATED : October 16, 2007
INVENTOR(S) : Keita Takahashi et al.

It is certified that error appears in the above-identified patent and that said Letters Patent is hereby corrected as shown below:

COLUMN 4:
Line 59, “exposure controlling” should read --exposure-controlling--.

COLUMN 5:
Line 16, “is” should be deleted.

COLUMN 6:
Line 26, “resin coated” should read --resin-coated--.
Line 57, “front ward” should read --frontward--.
Line 66, “rockably” should read --rocking--.

COLUMN 7:
Line 10, “aluminum shaped” should read --aluminum-shaped--.
Line 18, “as” should read --as a--.
Line 41, “rockably” should read --rocking--.
Line 43, “constitute” should read --constitutes--.

COLUMN 8:
Line 6, “thermister 7,” should read --thermistor 7,--.
Line 14, “thermister 7” should read --thermistor 7--.
Line 27, “dependently” should read --independently--.
Line 32, “in” should read --and--.
Line 67, “(resin coated” should read --(resin-coated--.

COLUMN 9:
Line 28, “resin coated” should read --resin-coated--.
Line 29, “resin coated” should read --resin-coated--.
Line 65, “life time” should read --a lifetime--.

COLUMN 10:
Line 1, “consists in determining” should read --to determine--.

COLUMN 11:
Line 6, “determined, if” should read --determined. If--.
Line 9, “If it is not driven, processing proceeds to step” should be deleted.
Line 10, “S211.” should be deleted.
Line 39, “in” should read --is in--.
Line 43, “if” should read --If--.
Line 52, “end of all print process” should read --the end of all print processing--.
Line 56, “process” should read --processing--.
Line 65, “is cooled” (2nd occurrence) should be deleted.

UNITED STATES PATENT AND TRADEMARK OFFICE

CERTIFICATE OF CORRECTION

PATENT NO. : 7,283,759 B2
APPLICATION NO. : 11/085548
DATED : October 16, 2007
INVENTOR(S) : Keita Takahashi et al.

It is certified that error appears in the above-identified patent and that said Letters Patent is hereby corrected as shown below:

COLUMN 12:
Line 4, “if” should read --If--.
Line 34, “if” should read --If--, and “end” should read --the end--.
Line 35, “process” should read --processing--.
Line 64, “fan” should read --fan 19--.

COLUMN 14:
Line 34, “transfeffing” should read --transferring--.

COLUMN 15:
Line 7, “transfeffing” should read --transferring--.
Line 9, “transfeffing” (both occurrences) should read --transferring--.

COLUMN 16:
Line 20, “same” should read --the same--.
Line 37, “if” should read --If--.
Line 60, “mined, if” should read --mined. If--.
Line 63, “end of fixing” should read --the end of the fixing--.

COLUMN 17:
Line 64, “fan 1-7” should read --fan 19--.

COLUMN 18:
Line 4, “when” should read --When--.
Line 16, “determined,” should read --determined.--.
Line 32, “same” should read --the same--.
Line 58, “an” should read --a--.

UNITED STATES PATENT AND TRADEMARK OFFICE

CERTIFICATE OF CORRECTION

PATENT NO. : 7,283,759 B2
APPLICATION NO. : 11/085548
DATED : October 16, 2007
INVENTOR(S) : Keita Takahashi et al.

It is certified that error appears in the above-identified patent and that said Letters Patent is hereby corrected as shown below:

COLUMN 20:
Line 28, "comprising" should read --further comprising--.

Signed and Sealed this

Twenty-third Day of September, 2008

JON W. DUDAS
*Director of the United States Patent and Trademark Office*